US006481397B2

(12) United States Patent
Suzuki

(10) Patent No.: US 6,481,397 B2
(45) Date of Patent: Nov. 19, 2002

(54) VARIABLE VALVE DRIVE SYSTEM FOR AN INTERNAL COMBUSTION ENGINE

(75) Inventor: Atsushi Suzuki, Iwata (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 0 days.

(21) Appl. No.: 09/683,788

(22) Filed: Feb. 14, 2002

(65) Prior Publication Data

US 2002/0129779 A1 Sep. 19, 2002

(30) Foreign Application Priority Data

Feb. 19, 2001 (JP) ..... 2001-077371

(51) Int. Cl.[7] ..... F01L 13/00; F01L 1/18; F02D 13/06

(52) U.S. Cl. ..... 123/90.16; 123/90.22; 123/90.4; 123/90.41; 123/198 F

(58) Field of Search ..... 123/90.15, 90.16, 123/90.22, 90.39, 90.4, 90.41, 90.42, 198 F

(56) References Cited

U.S. PATENT DOCUMENTS

| | | | | | |
|---|---|---|---|---|---|
| 4,901,684 | A | * | 2/1990 | Wride | 123/90.16 |
| 5,003,939 | A | * | 4/1991 | King | 123/90.16 |
| 5,365,895 | A | * | 11/1994 | Riley | 123/90.16 |
| 5,501,186 | A | | 3/1996 | Hara et al. | 123/90.16 |

FOREIGN PATENT DOCUMENTS

| | | |
|---|---|---|
| JP | 6-307219 | 11/1994 |

* cited by examiner

*Primary Examiner*—Weilun Lo
(74) *Attorney, Agent, or Firm*—Ernest A. Beutler

(57) ABSTRACT

A Variable valve lift mechanism that minimizes the number of components and also which permits a greater latitude of valve lift adjustment including the possibility of no valve lift under some running conditions. This is done without interference with other components of the engine and thus permits a compact engine assembly.

15 Claims, 4 Drawing Sheets

VARIABLE VALVE DRIVE SYSTEM FOR AN INTERNAL COMBUSTION ENGINE

BACKGROUND OF INVENTION

This invention relates to an internal combustion engine and more particularly to a variable valve drive system for such engines.

In order to improve the performance of an engine through a wide range of engine running conditions (speed and load), it has been proposed to utilize a system wherein the degree of lift or opening of one or more valves of the engine can be controlled. A number of different types of variable valve lift mechanisms have been employed but, for the most part, the range of valve lift adjustment that is possible is quite limited. This is basically because of the geometry of the systems, which have been proposed, and the operational methods, which they have employed.

For example, in one form of arrangement, a rocker arm is interposed between the cam lobe and the valve or valve actuating member. This rocker arm has its pivotal axis adjustable so as to in affect change the lever ratio and thus, alter the valve lift. An example of this type of valve lift control is shown in published Japanese Application Hei 7-91217 (U.S. Pat. No. 5,501,186).

As may be seen in this prior art construction, the rocker arm interposed between the cam lobe and the valve tappet has its pivot axis shifted in a transverse direction so as to change the effective lift of the valve. This is because the lever arm ratio is in effect changed. However, there are several disadvantages of this type of construction. First, the shifting of the pivot axis also causes the point of contact between the rocker arm and valve actuator to shift. Thus, the problem of wear in this area is aggravated and uniform wear is also made more difficult. Furthermore, since the shifting must be generally confined to the area immediately adjacent the axis of the actuated valve, the amount of variation in lift possible is restricted.

Another embodiment is shown in that application wherein different pivot points are utilized by having different pivot arrangements for the valve actuating rocker arm. However, this further limits the degree of adjustment and also causes the problem of having only step wise adjustment rather than adjustment over a range of positions.

Another type of system for adjusting the valve lift of an engine during running is shown in published Japanese Application Hei 6-307219. In this type of arrangement, the lever ratio of the rocker arm is in effect changed by providing a rolling follower that is interposed between the cam lobe and an upper surface of the rocker arm. This roller follower is shifted transversely to change the effective lever ratio. Again, however, this severely limits the degree of adjustment that can be made and also further complicates the overall structure. Furthermore, this system does not permit zero or not nearly zero lift for the valve actuation. In other words it is not possible to disable the valve operation.

It is, therefore, a principal object to this invention to provide an improved valve actuating system for an internal combustion engine wherein large degrees of variation in valve lift is possible.

It is a further object to this invention to provide a relatively simple and yet continuously variable valve lift control mechanism for the valves of an internal combustion engine.

It is a yet further object to this invention to provide an arrangement for controlling the valve lift an internal combustion engine that is compact in nature, while at the same time, maintains a large effective variation in valve lift.

SUMMARY OF INVENTION

This invention is adapted to be embodied in a variable valve operating system for the valves of an internal combustion engine and specifically one, which is capable of varying the degree of opening in response to the rotation of the cams to a large extent. The valve operating device comprises a rocker arm having a follower portion engaged by the cam. A pivot axis about which the rocker arm pivots in response to the action of the cam on the follower portion is provided. A valve operating portion is operatively engaged with the associated valve for effecting lift of the valve in response to pivotal movement of the rocker arm. A variable lift actuator is effective to change the distance between the point on the valve operating portion that operatively engages the valve without changing the point that is operatively engaged and the distance between that point and the pivot axis of the rocker arm so as to change the degree of lift between substantially no lift to substantially maximum amount of lift.

DETAILED DESCRIPTION

Figure 1:
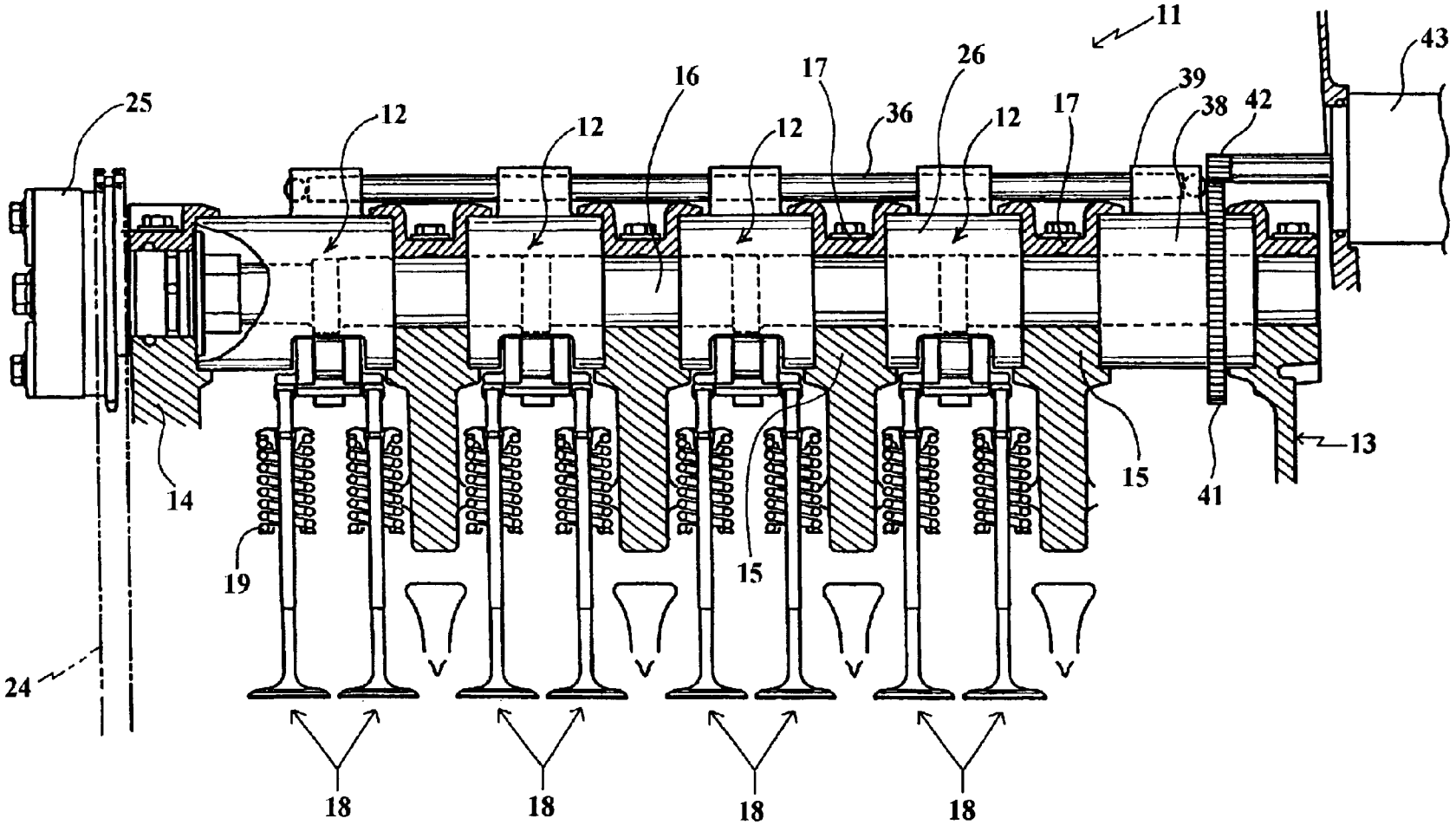
FIG. 1 is a conventional view taken through a portion of the cylinder head of an internal combustion engine constructed in accordance with an embodiment of the invention.

Referring now in detail to the drawings and initially primarily to FIG. 1, a portion of an overhead valve type internal combustion engine is illustrated. The engine is identified generally by the reference numeral 11. Although the invention is described in conjunction with overhead valve engines, it should be apparent that the invention can be utilized also with types of engines not having overhead valves.

Since the invention deals primarily with the valve operating mechanism and particularly the individual variable valve lift mechanisms, indicated generally by the reference numerals 12, only the cylinder head portion of the engine 11 is depicted. The cylinder head is identified generally by the reference numeral 13.

The cylinder head 13 includes a main body portion 14 that have upstanding walls 15 that form one-half of the bearing surfaces for a camshaft, indicated by the reference numeral 16. In the illustrated embodiment, the camshaft 16 can be either or both of an intake and/or an exhaust camshaft of the engine 11. The camshaft 16 has bearing portions that are journalled between the upstanding walls 15 of the cylinder head and by bearing caps 17 that are detachably affixed thereto.

In the illustrated embodiment, each of the variable valve lift mechanisms 12 operate a pair of valves for the same cylinder of the engine 11. The valves of the pairs each being indicated by the reference numerals 18.

As is typical with internal combustion engine practice, the valves 18 are poppet type valves, which are urged toward their closed positions by coil compression springs 19. These coil compression springs 19 encircle the stems 21 (see FIG. 2) of the valves 18. The springs 19 are loaded between engagement with suitable machined surfaces of the cylinder head and keeper retainer assemblies 22 fixed to the valve stems 21 in a well known manner.

The stems 21 carry adjusting shims 23, which form the actuating members for the valves 18. Although directly operated valves are shown, the invention can be also utilized in conjunction with arrangement wherein thimble tappets are interposed between the valves 18 and the cam lobes of the associated camshaft 16, to be described.

The camshaft 16 is rotatably driven by a camshaft drive mechanism, which may be of any known type. This may include, by way of example, a timing chain 24 that is driven either directly or through a transmission mechanism at one-half crankshaft speed from the crankshaft of the associated engine 11. This timing chain 24 is engaged with a variable valve timing mechanism 25 which may be of any known type and which is capable of shifting the timing phase of the camshaft 16 relative to the engine crankshaft.

Figure 2:
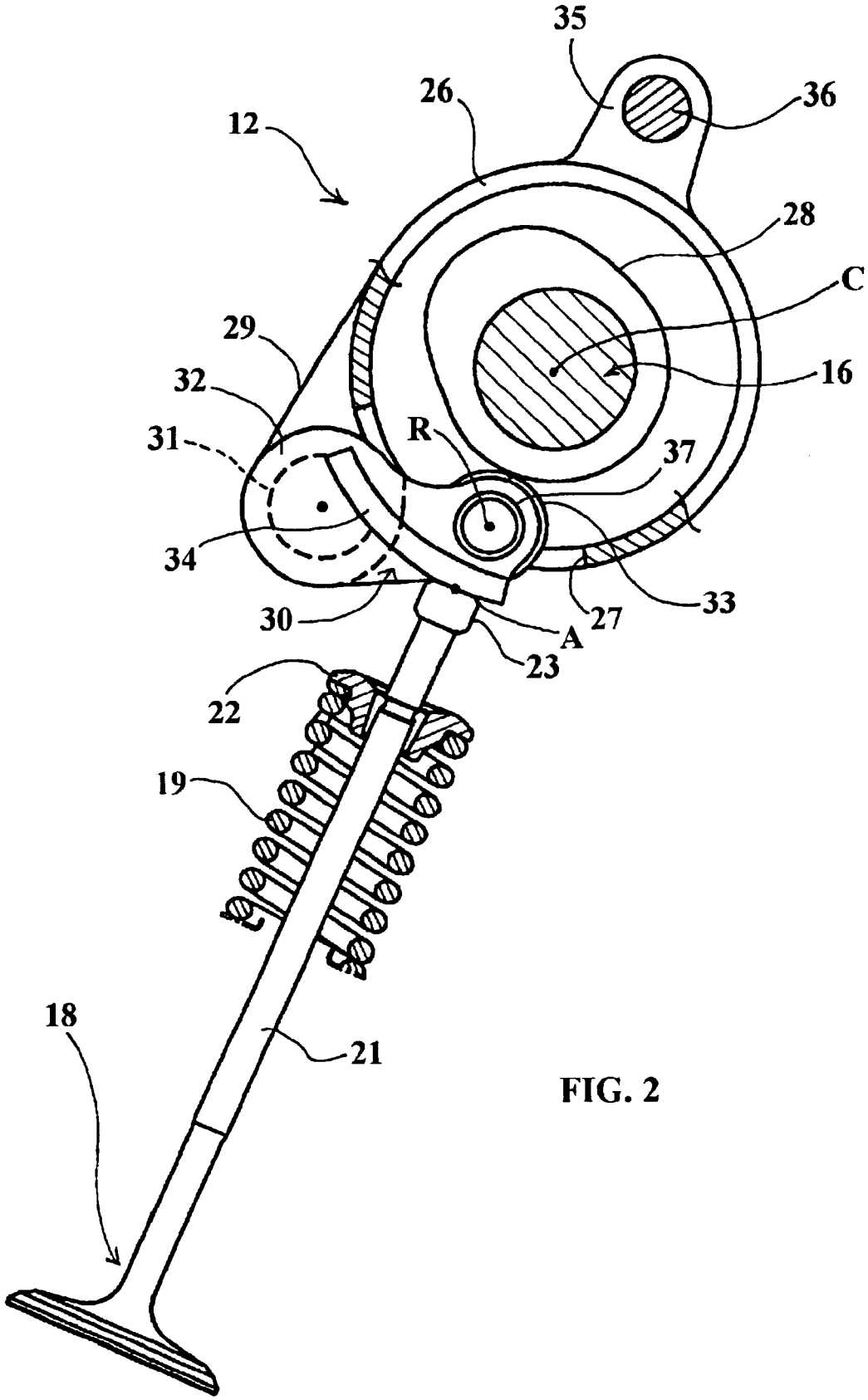
FIG. 2 is an enlarged cross sectional view taken along a plane perpendicular to the plane of FIG. 1.
Figure 3:
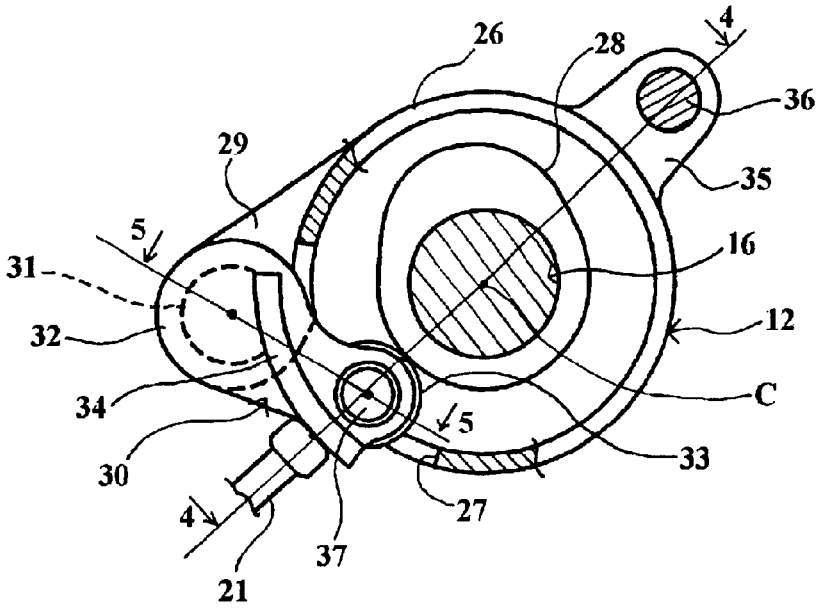
FIG. 3 is a view looking in the same direction as FIG. 2 but only showing the valve operating mechanism.

Referring now primarily to FIG. 2, the valve actuating mechanism including the variable valve lift mechanisms 12 will be described in detail. Each variable valve lift mechanisms 12 includes a cylindrical member 26, which has a slotted opening 27 for a purpose to be described. This cylindrical member 26 has an inner diameter that is larger than the diameter of the cam lobes 28 formed on the camshaft 16. The rotational axis of the camshaft 16 is indicated by the line C in FIG. 2.

Adjacent the slotted opening 27 and on one side thereof, the cylindrical member 26 has a lug like projection 29 that receives a pivot pin 31. The pivot pin 31, in turn, journals a valve actuating rocker arm assembly 30. The rocker arm assembly 30 is comprised of paired rocker arms 32 that are suitably connected to each other. These rocker arms 32 extend through the slotted openings 27 and carry roller followers 33 that are engaged with the cam lobes 28 so as to effect pivotal movement of the rocker arm 32 about the pivot axis formed by the pivot pin 31.

Each of these pair of rocker arms 32 also are provided with a valve actuating or contacting section 34 that has an arcuate shape with its center lying concentric with the rotational axis C of the camshaft 16.

Referring back to FIG. 1, it will be seen that each of the cylindrical member 26 of the variable valve lift mechanisms 12 is provided with a lug 35 is diametrically opposed to the slotted opening 27. A coupling rod 36 extends through openings in the lugs 35 of each of the variable valve lift mechanisms 12 so that their cylindrical members 26 all rotate in unison. This rotation is achieved in a manner, which will be described shortly.

Figure 4:
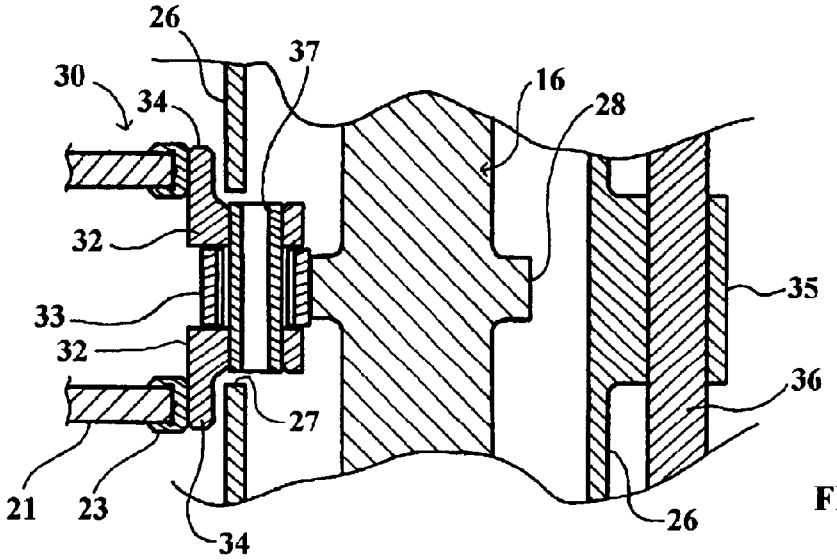
FIG. 4 is a cross sectional view taken along the line 4—4 of FIG. 3.
Figure 5:
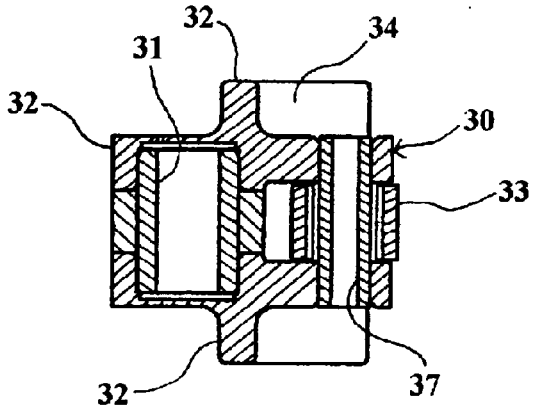
FIG. 5 is a cross sectional view taken along the line 5—5 of FIG. 3.

The roller followers 33 are supported on the rocker arms 32 by means of a roller follower pin 37, which further serve to couple the rocker arms 32 to each other (see FIG. 4).

Referring now to FIG. 1 it will be seen that at one end of the cylinder head 13, there is provided a drive sleeve 38 which, like the cylindrical members 26 of the variable valve lift mechanisms 12 is journalled between the cylinder head upstanding walls 15 and the bearing caps 17. The coupling rod 36 extends into a projection 39 on this drive sleeve 38.

The drive sleeve 38 is also provided with an integral gear 41 that is enmeshed with a driving pinion 42 of an electrical stepping motor 43, which can be mounted externally of the cylinder head assembly and thus, isolated from the heat of the engine.

At this point, it might be in order to indicate that the conventional variable valve lift mechanisms are normally operated by hydraulic motors that are supplied with pressure from the lubricating system of the engine. This has a number of disadvantages and does not easily permit the same engine to be utilized with or without a variable valve lift mechanism. In addition, heat is a factor in the operation of these systems and thus, by utilizing an electrical motor externally positioned, heat problems are substantially avoided.

Figure 6:
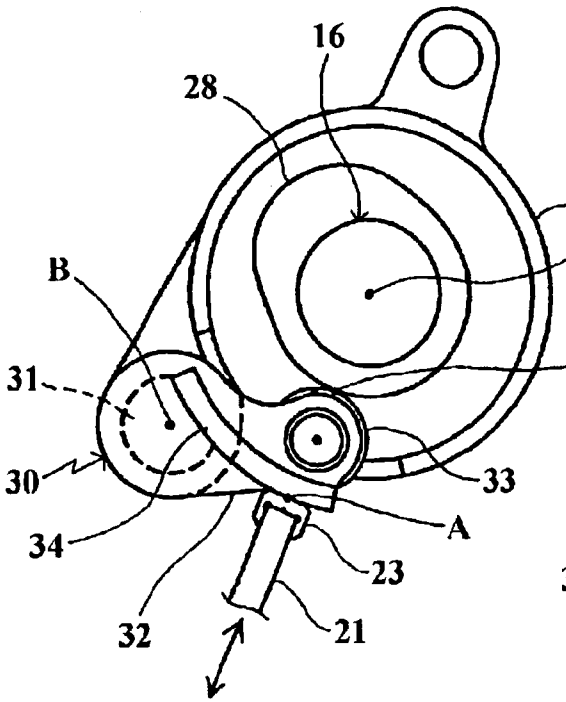

It has been previously noted that the valve actuating portion 34 of each rocker arm 32 is curved in shape and the curvature is about the axis of rotation C of the camshaft 16. Thus, in one extreme position of valve lift, the maximum valve lift as shown in FIGS. 2 and 6, the contact point A between this valve actuating portion 34 and the valve shim 23 is in line with the axis of the valve stem 21 and also is in line with the rotational axis R of the roller followers 33 and the camshaft rotational axis C. This is the point when the maximum valve lift is obtained.

Figure 7:
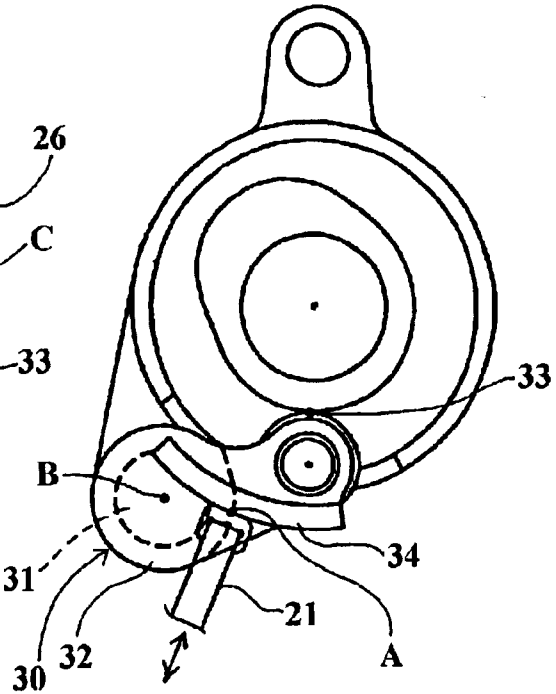

If less lift is required, the variable valve lift mechanisms 12 are rotated in a counter clockwise direction as shown in FIGS. 2 and 6 through 8 to an intermediate position as shown in FIG. 7.

In this position, the contact point A has moved to an intermediate portion along the curve length of the curved valve actuating portion 34. At the same time the pivot axis B of the rocker arms 32 is also moved in the same direction so as to shorten the effective lift length to the distance between the points B and A as seen in this figure.

Figure 8:
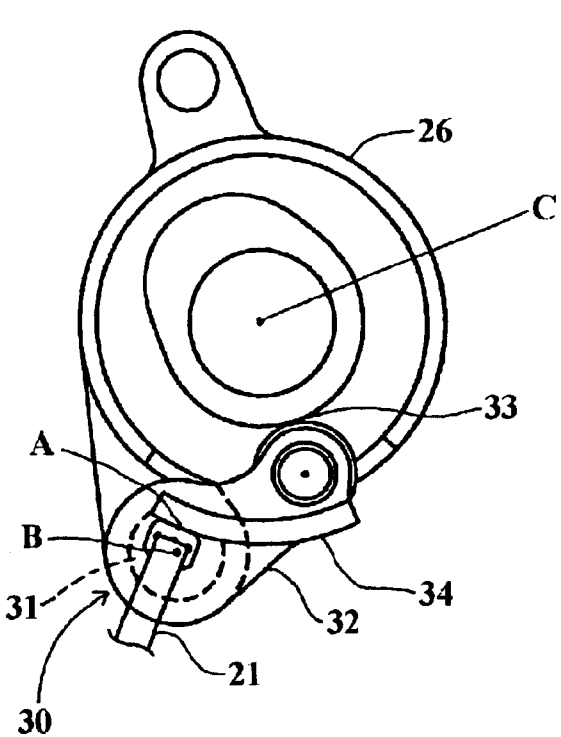
FIGS. 6, 7 and 8 are views, in part similar to FIG. 3, and show, respectively, maximum valve lift, middle variation in valve lift and small or no valve lift.

If the actuating motor 43 is energized further to rotate the cylindrical member 26 of the variable valve lift mechanism 12 to a further point as shown in FIG. 8, the valve lift can be substantially minimized. In fact, if there is a spherical end formed on the shim 23, which is preferred, then the point A will be in line with the camshaft rotational axis C and the center of the valve stem 21 so that the contact point A is on the center of the shim 23 and, accordingly, there will be no lift because there will in essence be no significant pivotal movement of the rocker arms 32.

That is, the rocker arm 32 may pivot slightly, but this will merely result in sliding movement of the valve actuating or contacting section 34 of the rocker arm across the valve shim 23 without its opening. Because of this operation the engine 11 can be operated without any throttle valves in the induction system. The engine speed can be controlled by varying the valve lift to control the induction air flow, thus simplifying the engine construction and improving transient response.

Thus, from the foregoing description, it should be readily apparent that the described embodiment of the invention provides a very wide range of valve lift adjustments without unduly complicated physical structure and without otherwise jeopardizing the valve actuation. In fact, this mechanism also reduces the necessity for subsequent valve adjustment due to wear since wear will be minimized. This mechanism also permits reduction in hydrocarbon emissions particularly during engine starting and even may eliminate the utilization of a throttle valve is used in conjunction with the intake valves because they can be retained from opening.

In the foregoing description, it has been disclosed that the variable valve lift mechanisms are all operated simultaneously. Of course, it would be possible to actuate them each independently. The invention has also been described in conjunction with an arrangement wherein the valve stem axis intersects the camshaft rotational axis but that need not be the case. Various other changes and modifications may be made without departing from the spirit and scope of the invention, as defined by the appended claims.

What is claimed is:

1. A poppet valve operating device for a poppet valve of an internal combustion engine and varying the degree of opening thereof in response to the rotation of a cam having a fixed lift profile, said poppet valve operating device being comprised of a rocker arm having a follower portion engaged by the cam, a pivot axis about which said rocker arm pivots in response to the action of the cam upon said follower portion, and a poppet valve operating portion operatively engaged with the associated poppet valve for effecting lift of the poppet valve in response to pivotal movement of said rocker arm, and a variable lift actuator effective to move said rocker arm around the axis of rotation of the cam for simultaneously changing the location of said rocker arm pivot axis, the area of said poppet valve operating portion that is operatively engaged with the associated poppet valve and the point where said follower portion engages the cam between a position where said rocker arm pivot axis is substantially intersected by the reciprocal axis of the associated poppet valve to provide substantially no lift to a position where said rocker arm pivot axis is spaced substantially from the reciprocal axis of the associated poppet valve to provide a maximum amount of lift.

2. A poppet valve operating device as set forth in claim 1, wherein the variable lift actuator moves the pivot axis of the rocker arm in a circular path around the cam shaft axis of rotation.

3. A poppet valve operating device as set forth in claim 1, wherein the device operates a pair of valves associated with a single cylinder of the associated engine from a single cam lobe.

4. A poppet valve operating device as set forth in claim 1, wherein the rocker arm valve operating portion has a curved configuration.

5. A poppet valve operating device as set forth in claim 4, wherein the curved configuration of the rocker arm valve operating portion is a segment of a circle.

6. A poppet valve operating device as set forth in claim 5, wherein center of the circle is coincident with the axis of rotation of the camshaft.

7. A poppet valve operating device as set forth in claim 6, wherein the variable lift actuator moves the pivot axis of the rocker arm in a circular path around the camshaft axis of rotation.

8. A poppet valve operating device as set forth in claim 4, wherein the rocker arm follower portion comprises a roller follower journalled by the rocker arm about a fixed axis.

9. A poppet valve operating device as set forth in claim 3, wherein the single cam lobe is engaged by a common follower portion carried by and coupling a pair of rocker arms, said pair of rocker arms further being coupled by a pivot member defining a common pivot axis about which said rocker arms pivots in response to the action of the cam upon said follower portion, and each of said pair of rocker arms has a respective valve operating portion operatively engaged with a respective one of the pair of valves for effecting lift of the valve in response to pivotal movement of said respective rocker arm.

10. A poppet valve operating device as set forth in claim 9, wherein the variable lift actuator comprises a cylindrical member surrounding the camshaft and supported for limited rotation about the axis of rotation of the camshaft.

11. A poppet valve operating device as set forth in claim 1, wherein the variable lift actuator comprises a cylindrical member surrounding the camshaft and supported for limited rotation about the axis of rotation of the camshaft.

12. A poppet valve operating device as set forth in claim 11, wherein the variable lift actuator has a lug portion carrying a pivot member about which the rocker arm pivots and the rocker arm extends through a slotted opening in the cylindrical member for engagement of the follower portion with the cam of the camshaft.

13. A poppet valve operating device as set forth in claim 12, wherein rotation of the cylindrical member varies the degree of lift of the valve.

14. A poppet valve operating device as set forth in claim 10, wherein the variable lift actuator has a lug portion carrying the pivot member about which the rocker arms pivot and the rocker arms extend through a slotted opening in the cylindrical member for engagement of the common follower portion with the cam of the camshaft.

15. A poppet valve operating device as set forth in claim 14, wherein rotation of the cylindrical member varies the degree of lift of the valves.

* * * * *